United States Patent [19]

Gottschlich

[11] 4,082,210

[45] Apr. 4, 1978

[54] APPARATUS FOR EQUALIZING TENSION IN A RIBBON CASSETTE

[75] Inventor: James A. Gottschlich, Bellbrook, Ohio

[73] Assignee: NCR Corporation, Dayton, Ohio

[21] Appl. No.: 739,918

[22] Filed: Nov. 8, 1976

[51] Int. Cl.[2] ..... B65H 17/42

[52] U.S. Cl. ..... 226/91; 197/151; 197/168; 226/113; 226/118

[58] Field of Search ..... 226/91, 92, 118, 119, 226/113, 114, 25; 197/168, 151; 360/95

[56] References Cited

U.S. PATENT DOCUMENTS

| | | | |
|---|---|---|---|
| 3,596,818 | 8/1971 | Curtis et al. | 226/25 |
| 3,682,363 | 8/1972 | Hull | 226/118 |
| 3,902,680 | 9/1975 | Neff | 226/91 X |
| 3,973,707 | 8/1976 | Pratt et al. | 226/118 |

*Primary Examiner*—Bruce H. Stoner, Jr.
*Attorney, Agent, or Firm*—J. T. Cavender; Albert L. Sessler, Jr.; Elmer Wargo

[57] ABSTRACT

An apparatus for equalizing the tension of a ribbon in a cassette having an exit area and an entrance area between which a first portion of the ribbon is exposed. The apparatus includes a frame for mounting the cassette thereon and a clamp for clamping the first portion to prevent the ribbon from being pulled out of the entrance area. Fingers are employed to grasp the ribbon and pull out a length of the ribbon from the exit area of the cassette, and the internal drive mechanism of the cassette is used to return the length of ribbon back into the cassette through the entrance area upon the release of the clamp. The apparatus is automatically operated for controlling the number of cycles of pulling out the ribbon and returning it to the cassette.

7 Claims, 9 Drawing Figures

112
108
60
64
236
214
110
114
100
104
226
68
234
228
FLOW CONTROL VALVE
229
224
BLEED VALVE
222
232
230
"T"
216
185
SOLENOID
SOLENOID
184
EXHAUST PORT
240
218
238
SOURCE OF AIR PRESSURE
215

APPARATUS FOR EQUALIZING TENSION IN A RIBBON CASSETTE

BACKGROUND OF THE INVENTION

This invention relates to an apparatus for equalizing the tension of a ribbon in a cassette.

In recent years there has been a trend to employ inked-ribbon cassettes for use with business machines like, for example, accounting machines, printers, and typewriters. These cassettes are usually low cost items which facilitate the loading of an inked ribbon into a business machine and eliminate the messy operation usually associated with loading reels of inked ribbons into the machine.

One type of ribbon cassette currently employed on business machines is the stuffed ribbon variety. This type of cassette has a storage chamber wherein convolutions or folds of the ribbon are stored. The cassette has an internal feed or drive mechanism which pulls the ribbon from an exit area of the cassette past a printing station and pulls it back to an entrance area of the cassette where the ribbon is pushed back into the chamber of the cassette by the internal feed mechanism which is usually externally powered. The convolution or folds of the ribbon are formed in the chamber near the entrance area, and the chamber is usually designed to facilitate the flow of the convolutions of ribbon in the chamber from the entrance area to the exit area of the cassette.

One of the problems associated with ribbon cassettes of the type described in the previous paragraph is that during the initial loading of ribbon into the cassette, the initial convolutions or folds of ribbon which are formed in the now empty cassette are quite large compared to those which are later formed when the cassette approaches the fully loaded condition. These large convolutions of ribbon present a problem when the cassette is initially used on a business machine because they are more difficult to pull out of the exit area of the cassette than are the small ones. The large convolutions present an increased drag or tension on the ribbon causing the ribbon to be frayed when the ribbon is driven by its own internal feed or drive mechanism. Also, if the ribbon does not advance during a printing operation, repeated use of one area of the ribbon may cause the ribbon to wear through at that area, thereby shortening the life of the ribbon and cassette.

The present invention obviates the problems mentioned in the previous paragraph in that it reduces or eliminates the premature failure of a ribbon cassette due to the excessive drag or tension created by the large convolutions of ribbon formed in a cassette during the initial loading thereof.

SUMMARY OF THE INVENTION

This invention relates to an apparatus for equalizing the tension of a ribbon in a cassette having an exit area and an entrance area between which a portion of the ribbon is exposed. The apparatus includes a frame means for mounting a cassette thereon, means for restraining or clamping the first portion of the ribbon to prevent the ribbon from being withdrawn or pulled out of the entrance area, means for pulling a length of ribbon out of the casette (to pull out the large convolutions mentioned earlier herein) by pulling the first portion of the ribbon between the clamping means and the exit area, and means for driving the length of ribbon back into the cassette through the entrance area upon the release of the clamping means. The pulling out of a length of ribbon and returning it to the cassette is considered a cycle, and the apparatus of this invention can automatically perform a designated number of such cycles to equalize the tension on the ribbon.

These advantages and others will become more readily understood in connection with the following specification and drawings.

DETAILED DESCRIPTION OF THE INVENTION

Figure 1:
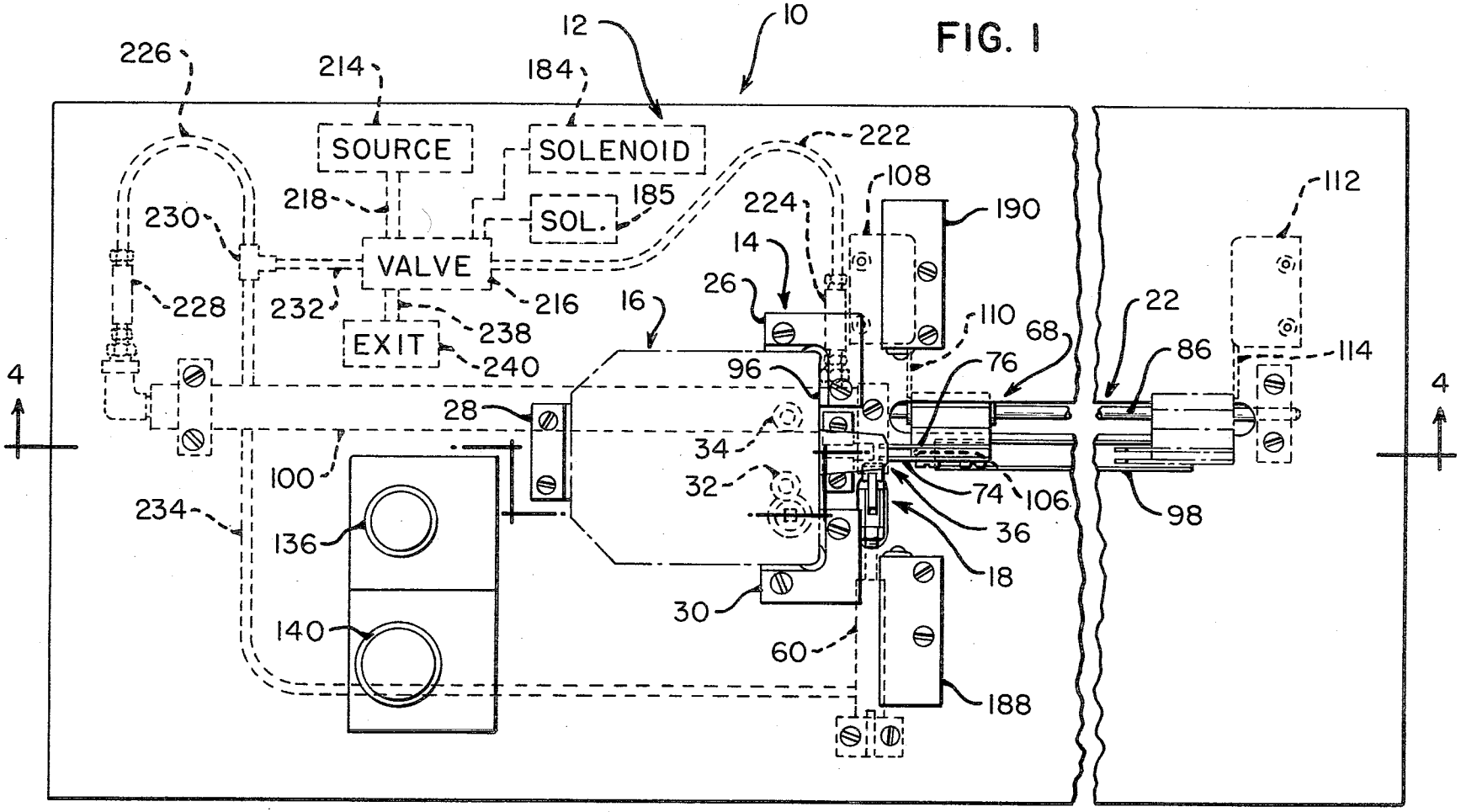
FIG. 1 is a plan view of the apparatus of this invention showing a frame means; means for mounting a cassette on the frame means; means for clamping a first portion of the ribbon between the exit and entrance areas of the cassette; and means for pulling a length of ribbon out of the exit area thereof.

FIG. 1 is a plan view of an apparatus designated generally as 10 which embodies the principles of this invention. The apparatus 10 includes a frame means designated generally as 12, mounting means 14 for detachably mounting a ribbon cassette 16 on said frame means 12, restraining or clamping means 18 for clamping an exposed first portion 20 (FIG. 7) of the ribbon from the cassette 16, and withdrawing or pulling means 22 for pulling a length 24 (FIG. 3) of ribbon from the cassette 16.

The mounting means 14 (FIG. 1) includes locating blocks 26, 28 and 30 which locate the position of the cassette 16 on the frame means 12, and any conventional means like locking pins 32, 34 may be used to detachably secure the cassette 16 on the frame means 12.

Figure 7:
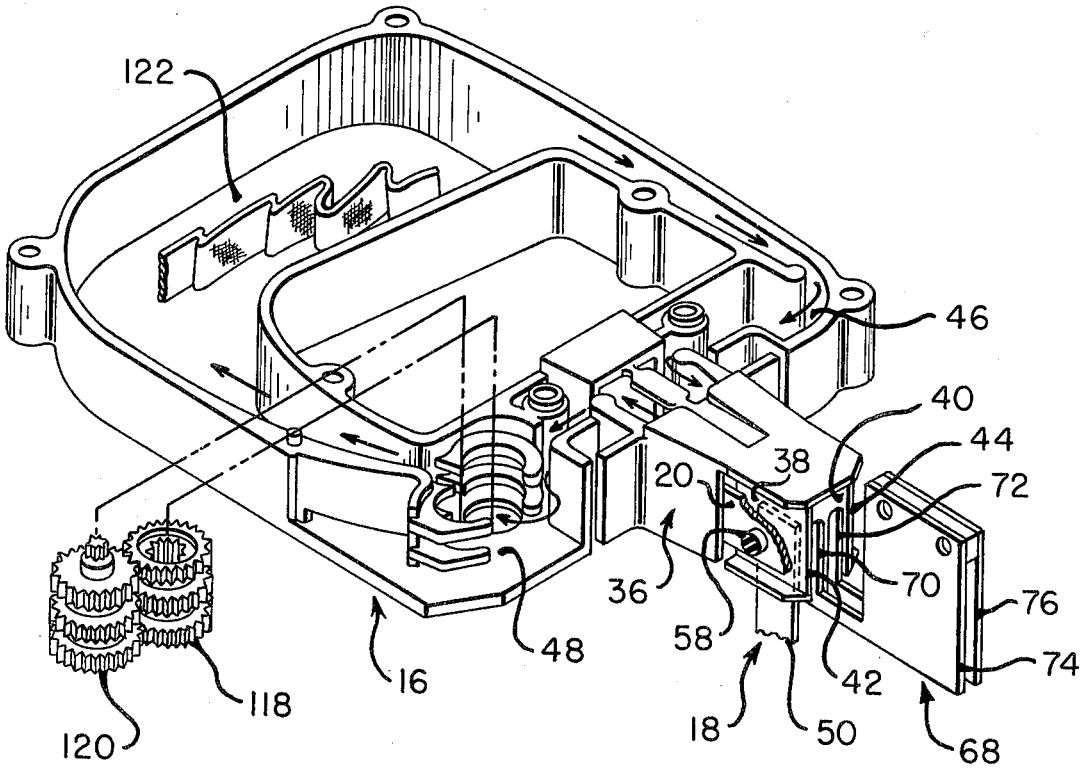
FIG. 7 is a perspective view of a cassette showing how the clamping means and the finger means are positioned relative to an exposed first portion of the ribbon to automatically engage said first portion.

The particular cassette 16 shown in the drawings has a nose portion 36, as is best seen in FIG. 7, in which the first portion 20 of the ribbon is exposed. The nose portion 36 has walls 38 and 40 which terminate in edges 42 and 44, respectively, and the edges 42 and 44 lie in a common plane to support the first portion 20 of the ribbon, for example, in printing relationship with a printer (not shown). The first portion 20 of the ribbon passes around wall 40, edge 44, edge 42, and wall 38 in passing from an exit area 46 of the cassette 16 to an entrance area 48 thereof.

Figure 5:
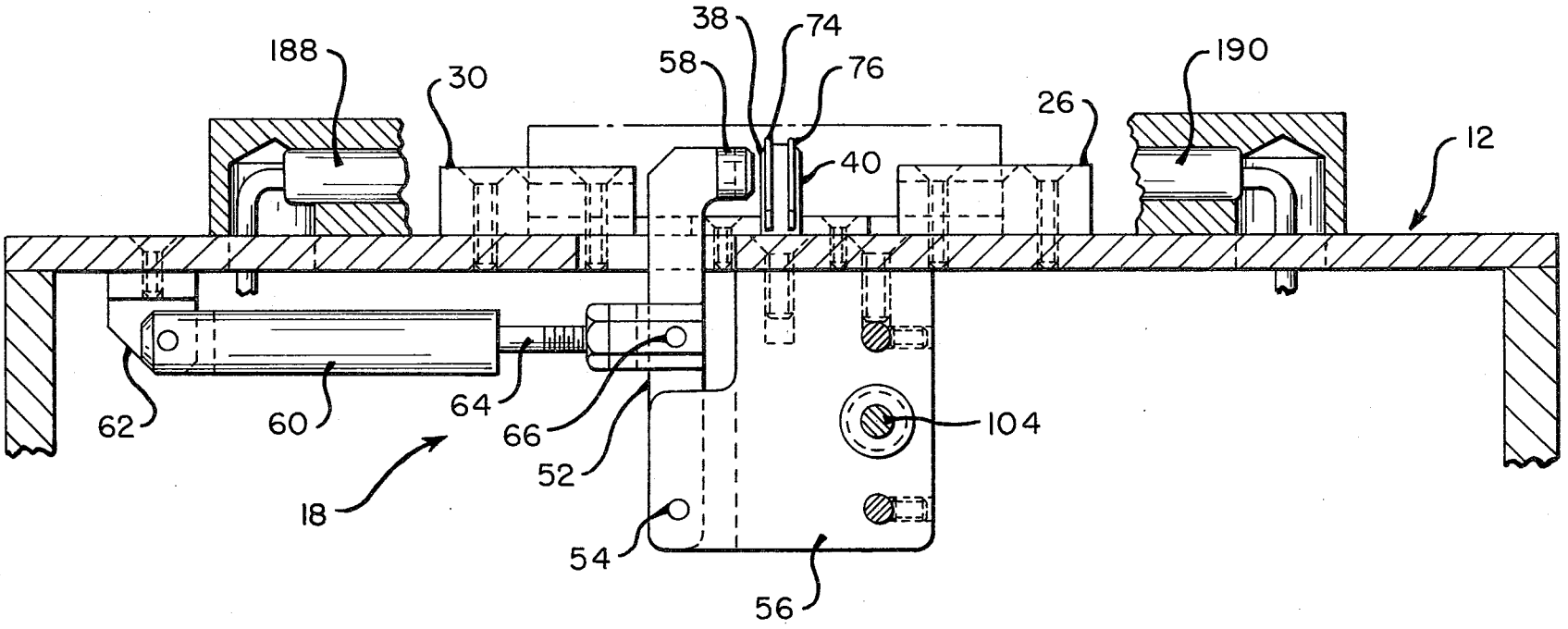
FIG. 5 is an elevational view, partly in cross section, and is taken along the line 5—5 of FIG. 4 to show additional details of the apparatus of this invention.

The clamping means 18 includes a stationary member 50 which is positioned on the frame means 12 to lie behind and in supporting relationship to wall 38 when a cassette 16 is positioned on the frame means 12, as is best shown in FIG. 7. The clamping means 18 also includes a lever 52 whose lower end is pivotally mounted on a pin 54 (FIG. 5) which is supported in a support 56 which is perpendicularly secured to the frame means 12. The free end of lever 52 has a resilient member 58 secured thereto and which is aligned with the first portion 20 of the ribbon to clamp the ribbon against the wall 38 on the cassette 16 when the lever 52 is pivoted in a clockwise direction (as viewed in FIG. 5) by a pneumatic cylinder 60 or actuator. The cylinder 60 has one end which is fixed to a bracket 62 on the frame means 12, and its operating arm 64 is pivotally joined to the lever 52 between its ends by a pin 66. When the cylinder 60 is actuated, the operating arm 64 forces the resilient member 58 towards the wall 38, clamping the first portion 20 of the ribbon against the wall 38 to prevent the first portion 20 of the ribbon from being moved or pulled out of the entrance area 48 (FIG. 7) of the cassette 16 by the pulling means 22 (FIG. 1); the stationary support 50 provides a back-up support for the wall 38 during this time.

Figure 4:
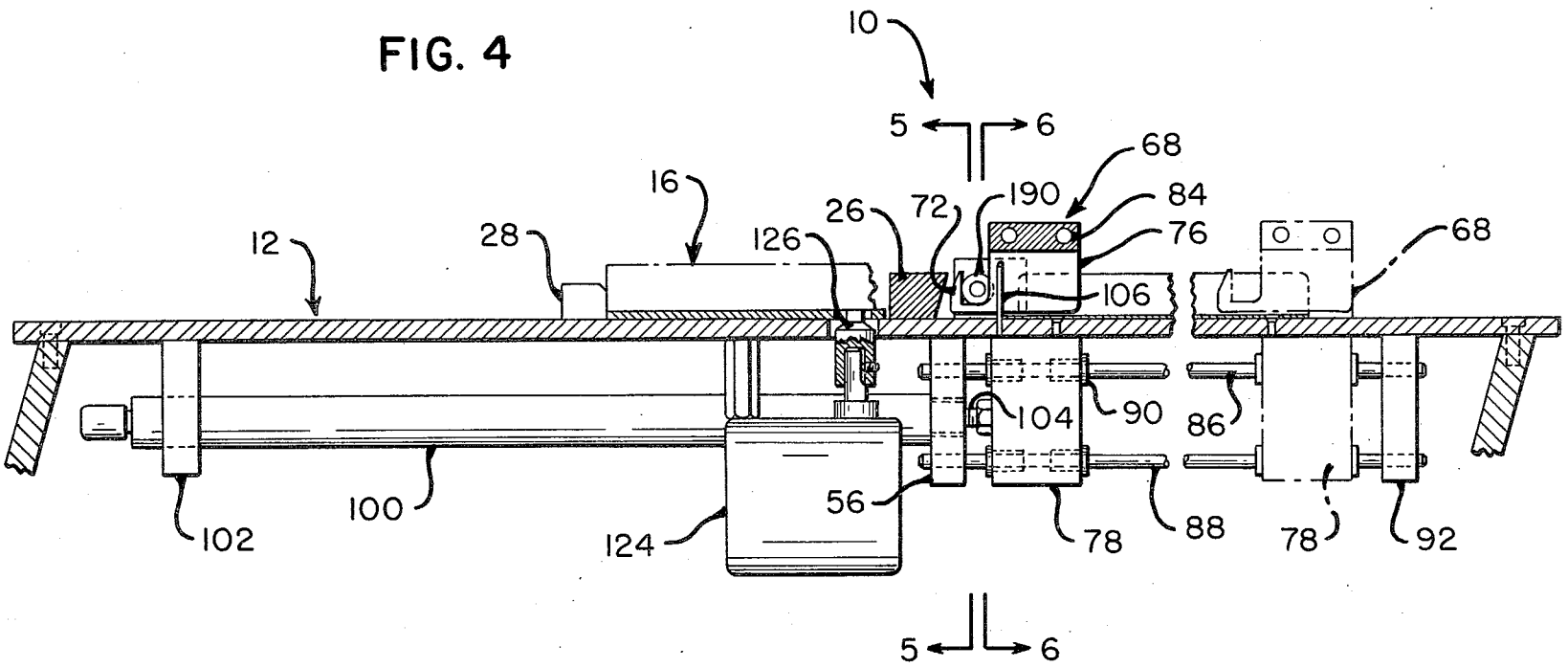
FIG. 4. is an elevational view, partly in cross section, and is taken along the line 4—4 of FIG. 1 to show additional details of the apparatus of this invention, with a portion of the cassette being removed to facilitate the showing thereof.

The pulling means 22, alluded to earlier herein, includes a finger means 68 (FIG. 1) which is moved between first and second positions relative to the cassette 16. The finger means 68 includes first and second fingers 70, 72 (FIGS. 4, 7) which extend from plates 74 and 76, respectively. The plates 74 and 76 are secured to a vertically aligned support 78 by spacers 80 and 82 (FIGS. 2 and 6) and suitable fasteners 84. The support 78 is slidably mounted on a pair of spaced parallel rods 86, 88 via bushings (like 90), and the ends of these rods are secured to the support 56 and a similar support 92 (secured to the frame means 12) as is best shown in FIG. 4. The support 78 is aligned in a slot 94 (FIG. 2) in the frame means 12, and the slot 94 and rods 86, 88 are aligned to enable the finger means 68 to be reciprocated between the first and second positions in a direction which is perpendicular to the front edge 96 of the cassette 16, and to enable the length 24 of ribbon to be pulled out of the cassette with a minimum amount of tension on the ribbon. A "U"-channel member 98 (best seen in FIGS. 2 and 6) is aligned parallel to the slot 94 and is secured to the frame means 12 to provide a channel in which the fingers 70 and 72 are reciprocated to establish an unobstructed path for the fingers 70, 72 to reciprocate. The finger means 68 is reciprocated between the first and second positions by a pneumatic cylinder 100 or actuator which is fixed in the support 56 (FIG. 4) and a second support 102 (FIG. 4). The operating arm 104 of the cylinder 100 is fixed to the vertical support 78 to reciprocate it and the finger means 68 as previously described.

Figure 2:
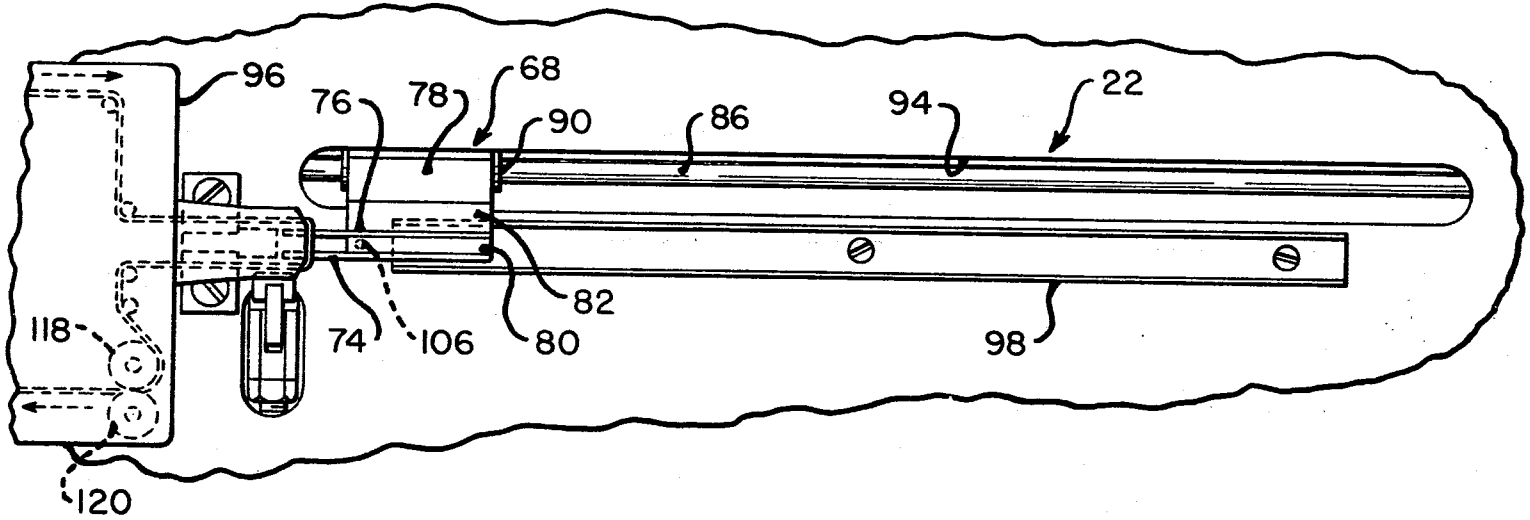
FIG. 2 is a plan view, similar to FIG. 1, showing more details of the clamping means and pulling means.

The pulling means 22 also includes a stationary post 106 which is positioned between the plates 74, 76 of the finger means 68 when the finger means 68 is in the first position as shown in FIGS. 1, 2 and 4, and the post 106 is secured to the frame means 12. The finger means 68 is shown in the extended or second position in FIG. 3. A limit switch 108 has an actuating arm 110 thereon (FIGS. 1 and 6) to engage the support 78 when the finger means 68 approaches the first position. The limit switch 108 is used to control the movement of the cylinder 100 in one direction, and a similar limit switch 112 and operating arm 114 (FIG. 1) are used to control the movement of the arm 104 of the cylinder 100 in the opposite direction to position the finger means 68 in the first and second positions with respect to the cassette 16.

When the finger means 68 is in the first position shown in FIGS. 1 and 7, for example, the fingers 70 and 72 are positioned inside the walls 38, 40 of the cassette 16 and inside the plane formed by edges 42, 44 to enable the first portion 20 of the ribbon to be automatically grasped by the fingers 70, 72 when the pulling means 22 is actuated by a control means 116 (FIG. 8) to be later described herein. As the finger means 68 is moved towards the second position (while the clamping means 18 is energized) the first portion 20 of the ribbon 20 will engage the post 106 as the fingers 70, 72 pass thereby. As a result of further movement of the finger means 68 towards the second position shown in FIG. 3, a length 24 of ribbon will be pulled out of the exit area 46 of the cassette 16 and will form the pattern shown in FIG. 2. Coming from the exit area 46 of the cassette, the length 24 of ribbon passes around the finger 72, around the post 106, and around the finger 70 back to the clamping means 18. The fingers 70, 72 and the post 106 have smooth rounded profiles to enable the length 24 of ribbon to slidably pass therearound. The advantage of using the post 106 is that it enables a long length 24 of ribbon to be pulled out of the cassette 16 with a relatively short stroke of actuating cylinder 100. For example, with a nine inch stroke of the arm 104 of cylinder 100, four sub-multiple lengths of approximately nine inches each are formed, making the total length of ribbon pulled out of the cassette 16 in one stroke approximately 36 inches.

Figure 3:
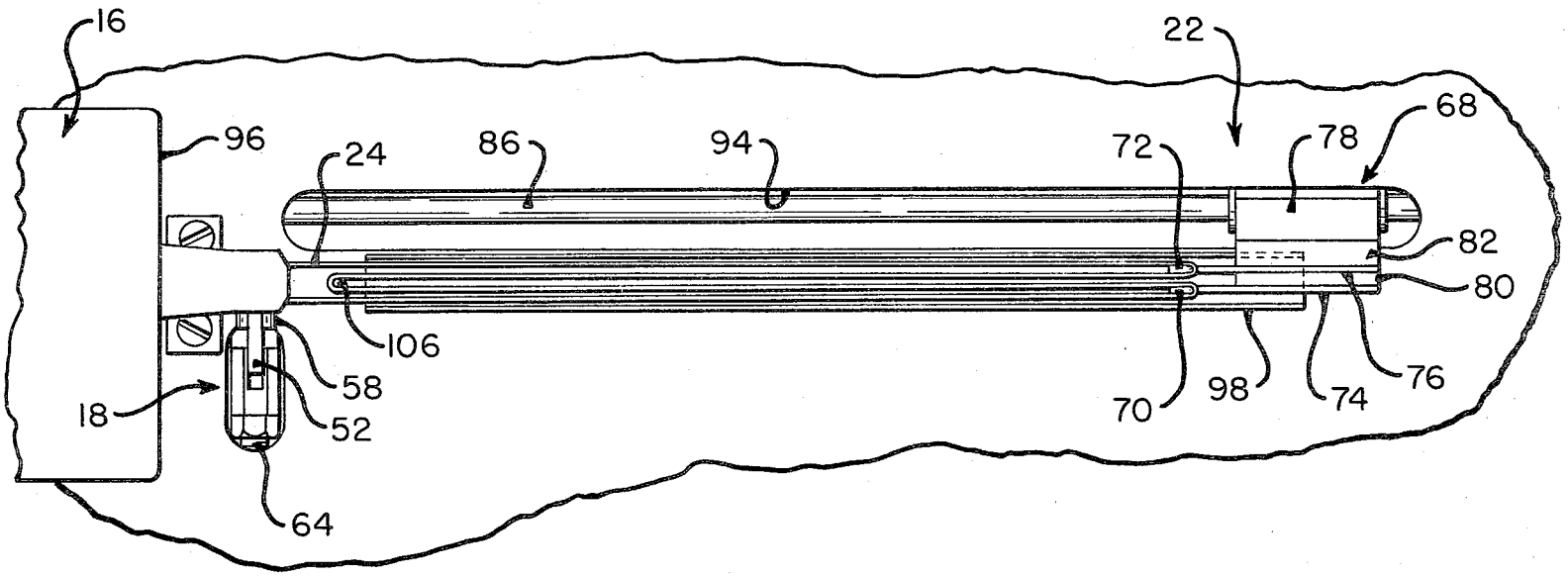
FIG. 3 is a plan view similar to FIG. 2 showing a length of ribbon being withdrawn from the cassette by the pulling means, and showing details of a finger means associated with the pulling means.

After the finger means 68 has been moved to the second position shown in FIGS. 3 and 4, the clamping means 18 is released by the control means 116 (FIG. 8), and the length 24 of ribbon which was pulled out of the cassette is fed back into the cassette 16 via its own internal drive mechanism, comprising a drive wheel 118 (FIG. 7) and an idler wheel 120 which is resiliently biased into engagement with the drive wheel 118 to drive the ribbon therebetween into the storage chamber 122 of the cassette 16. The drive wheel 118 is driven by a motor 124 (FIG. 4) having a driving spline 126 which drivingly engages the drive wheel 118 when the cassette 16 is mounted on the frame means 12. As the length 24 of ribbon is driven back into the cassette 16, the return stroke on the cylinder 100 is made at a rate which is faster than that at which the ribbon is being fed back into the cassette 16 by the motor 124 so as to minimize the tension on the ribbon. When the finger means 68 reaches the first position shown in FIG. 1, one cycle is completed, and the process is repeated for several additional cycles, usually about five cycles, until all the large convolutions of ribbon which have been located near the exit area of chamber 122 have been withdrawn from the cassette 16. These large convolutions of ribbon are difficult to pull out of the cassette 16 by the cassette's own internal drive means as mentioned earlier herein.

Figure 8:
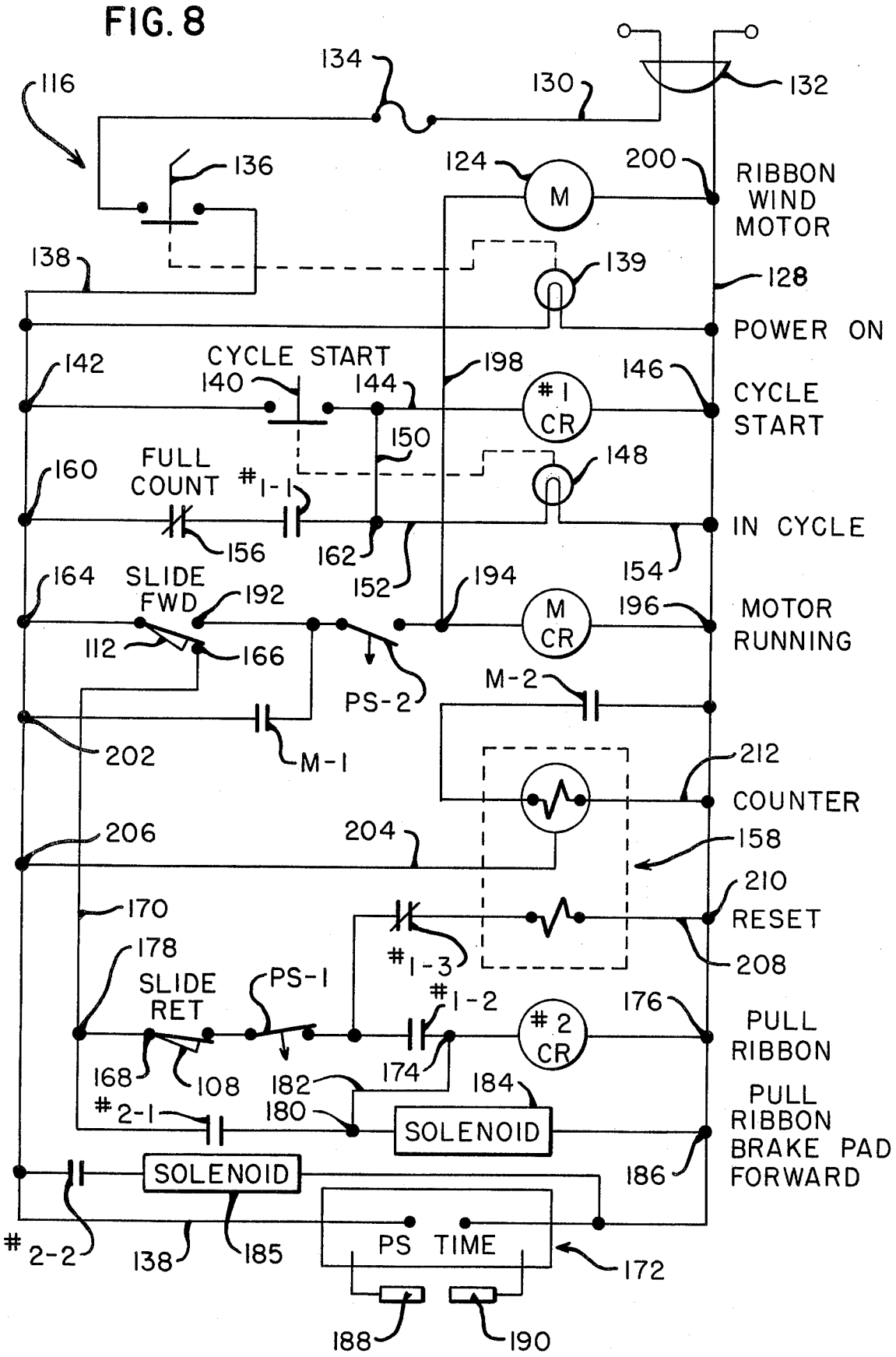
FIG. 8 is a schematic diagram of a control circuit used with the apparatus of this invention.

The control means 116 alluded to earlier herein is shown in FIG. 8. The control means 116 includes a first common conductor 128 and a conductor 130 which are connected to a source 132 of energizing voltage. The conductor 130 has a fuse 134 therein and is connected to a main switch 136 which is shown in the off position. When the switch 136 is actuated, it connects the conductor 130 to a second common conductor 138 and turns on an indicator light 139 to indicate that power is on.

The control means 116 (FIG. 8) also includes a cycle start switch 140 which is connected to conductor 138 at a connection point or terminal 142 and is series connected to one terminal of a #1 control relay (hereinafter referred to as #1CR) by a conductor 144, and the other terminal of relay #1CR is connected to a connection point or a terminal 146 on conductor 128. Whenever switch 140 is closed, an "in cycle" indicator light 148 is energized via conductors 150, 152, and 154 to indicate that the apparatus 10 is in a cycling status. When switch 140 is closed, control relay #1CR is energized, and a holding circuit therefor is provided via normally open (N.0.) contacts #1-1(associated wit #1CR) and normally closed (N.C.) contacts 156 (associated with a conventional counter designated generally as 158). The N.O. contacts #1-1 and the N.C. contacts 156 are series connected to conductor 138 at terminal 160 and conductor 150 at terminal 162. Limit switch 112 (also shown in FIG. 1) is in the position shown in FIG. 8 when the finger means 68 is in the home position shown in FIG. 1, and is used to set up a circuit to enable the finger means 68 to pull the ribbon 24 out of the cassette 16. The limit switch 112 is a single pole, double-throw-type switch which has its common terminal connected to conductor 138 at terminal 164 and one of its terminals 166 connected to one terminal 168 of the limit switch 108 (also shown in FIG. 1) by a conductor 170. Limit switch 108 is closed when the finger means 68 engages the operating arm 110 thereof as shown in FIG. 1. The limit switch 108 is series connected with a switch PS-1 which is associated with a conventional photo-switch designated generally as 172. The switch PS-1 is connected to a set of N.O. contacts #1-2 associated with control relay #1CR at terminal 174. The contacts #1-2 are in series with a second control relay #2CR which is connected to the first conductor 128 at terminal 176. When the switches 112, 108, and PS-1 are in the positions shown in FIG. 8, and when control relay #1CR is energized (to close contacts #1-2), the control relay #2CR will also be energized. A holding circuit for control relay #2CR is provided by N.O. contacts #2-1 which close when the relay #2CR is energized. Contacts #2-1 are connected to terminal 178 (on conductor 170) and terminal 180 which in turn is connected to terminal 174 via a conductor 182. A solenoid 184 (also shown in FIG. 9) has one end connected to terminal 180 and the remaining end thereof connected to a terminal 186 on the common conductor 128. The solenoid 184 and a second solenoid 185 control a conventional fluid reversing valve 216 (FIGS. 1 and 9) which is used for controlling the operation of cylinders 100 and 60 as will be described hereinafter; solenoid 184 becomes energized whenever control relay #2CR is energized, and solenoid 185 becomes energized whenever control relay #2CR is deenergized. Solenoid 184 is series connected with a set of N.C. contacts #2-2 (associated with control relay #2CR) between the conductors 138 and 128 as shown.

Figure 6:
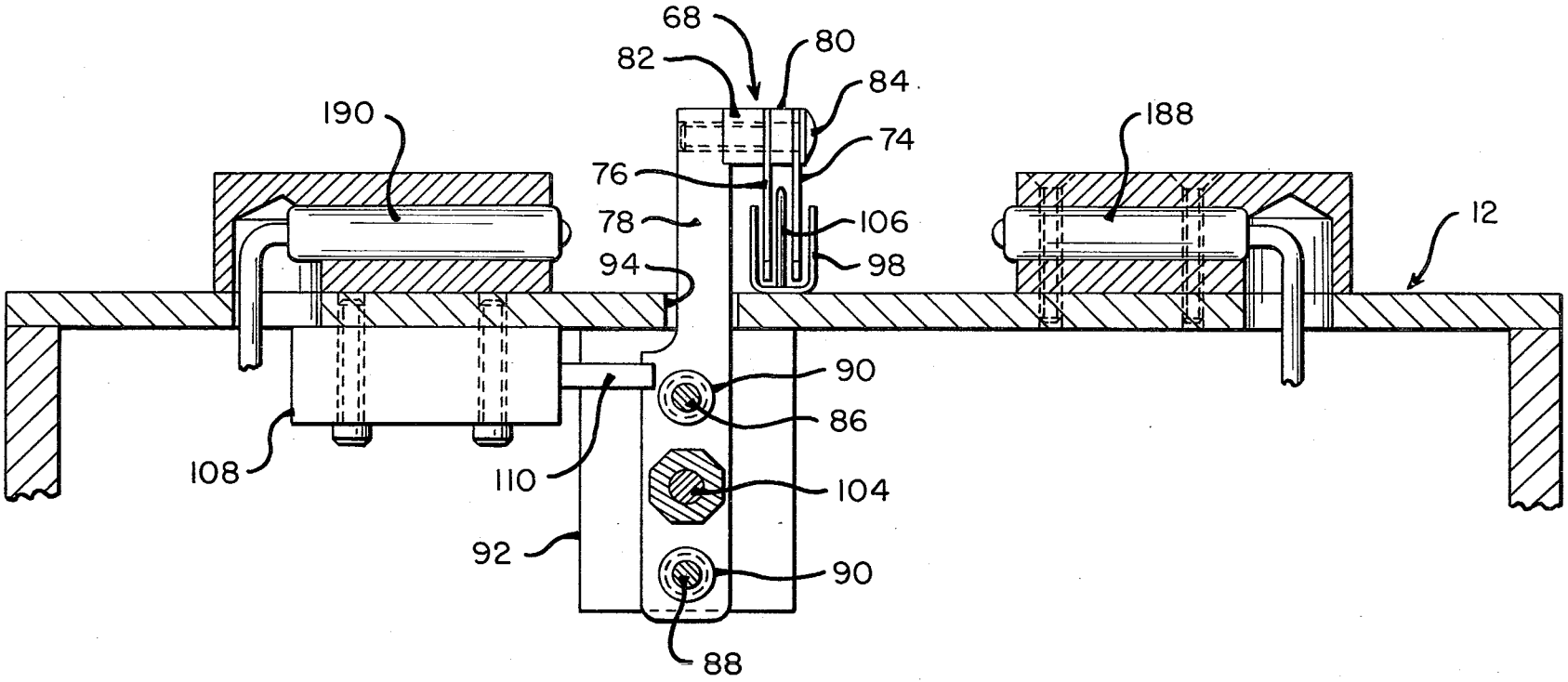
FIG. 6 is an elevational view, partly in cross section, and is taken along the line 6—6 of FIG. 4 to show additional details of the apparatus of this invention.

The photoswitch 172 (FIG. 8) has a light source 188 and a light detector 190 associated therewith as also shown in FIGS. 1, 4 and 6. When the finger means 68 is in the positions shown in FIGS. 1 and 4, light from light source 188 reaches the light detector 190 to place switch PS-1 in the closed position shown in FIG. 8, and to simultaneously place a second switch PS-2 (associated with photoswitch 172) in the open position shown in FIG. 8. When a length 24 ribbon is pulled out of the cassette 16, it interrupts the beam of light between light source 188 and detector 190 to open switch PS-1 and close switch PS-2. Switch PS-2 is connected to a second terminal 192 associated with limit switch 112 and one terminal 194 of a motor control relay MCR whose remaining terminal is connected to a terminal 196 on the common conductor 128. A conductor 198 of the rewind motor 124 is connected to terminal 194 and the other conductor thereof is connected to the common conductor 128 at terminal 200. Motor control relay MCR has a holding circuit provided therefor via a set of N.O. contacts M-1 which are connected to a terminal 202 on common conductor 138 and terminal 192 on limit switch 112 as shown.

As alluded to earlier herein, the counter 158 is a conventional counter which, for example, may be a CE-62 predetermined electrical counter, manufactured by General Controls. The counter 158 has an energizing conductor 204 connected to terminal 206 of common conductor 138 and a reset conductor 208 connected to terminal 210 on common conductor 128. Each time the motor control relay MCR is energized, a second set of N.O. contacts M-2 associated therewith is closed to advance the count in the counter 158 by one; line 212 is an energizing line associated with the counting circuit therein. The counter 158 has count setting means thereon (not shown) upon which the number of cycles to be repeated in the apparatus 10 is set. When the predetermined count or number of cycles is reached, the N.C. contacts of switch 156 associated with the counter 158 are opened, indicating a full count. The counter 158 is reset by a set of N.C. contacts #1-3 associated with control relay #1CR, i.e. whenever the control relay #1CR is deenergized, the counter 158 is reset.

Figure 9:
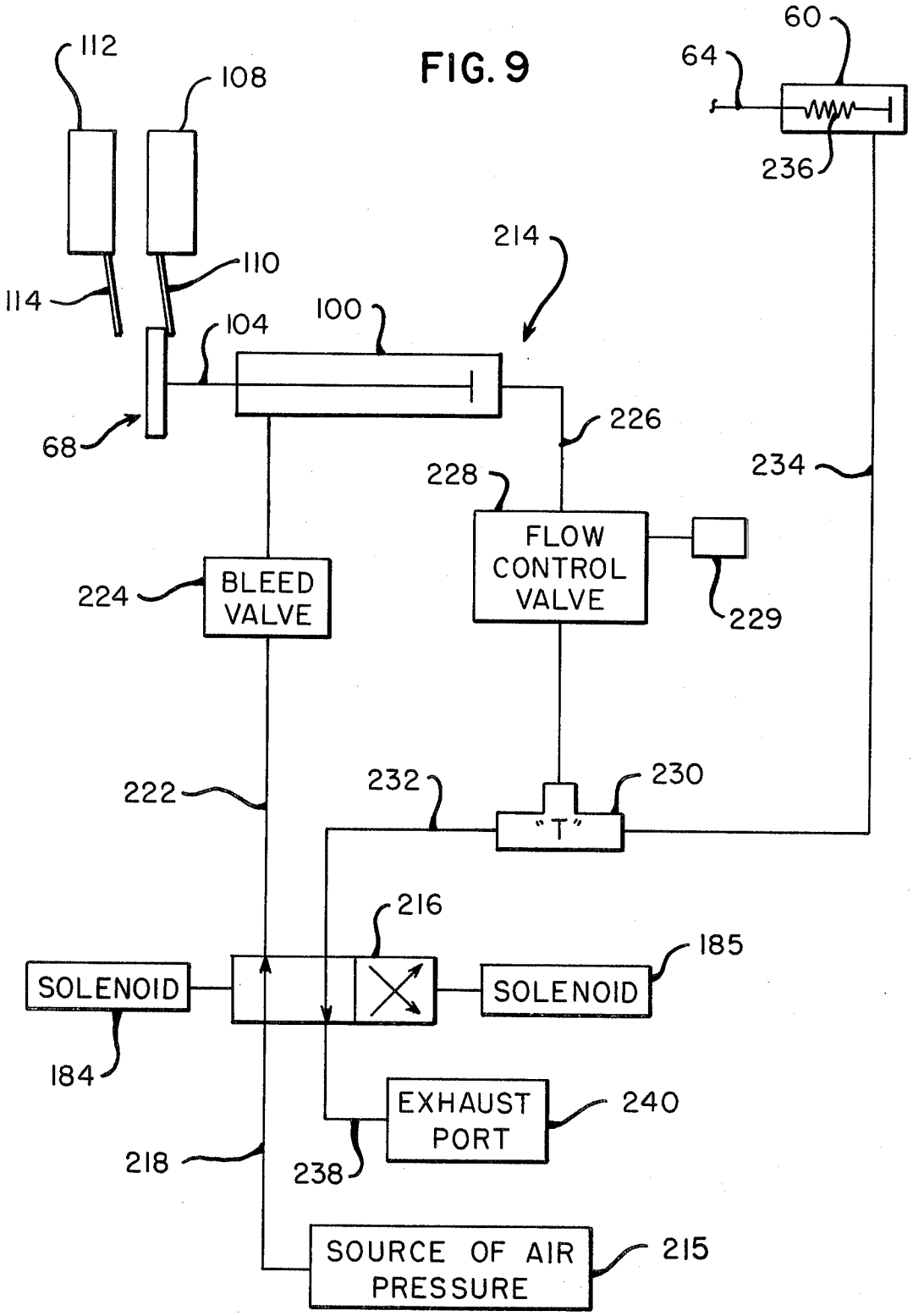
FIG. 9 is a schematic diagram of a pneumatic circuit used with the apparatus of this invention.

Before describing the operation of the apparatus 10 under the control of the control means 116 shown in FIG. 8, it would appear best to first describe the operation of a pneumatic circuit associated with the apparatus 10 and designated generally as 214 in FIG. 9 which is shown in schematic form.

The pneumatic circuit 214 (FIG. 9) includes a conventional source 215 of air pressure to which is connected a conventional reversing valve 216 by a conduit 218. The valve 216 is pulled to the position shown in FIG. 9 by the solenoid 185 whenever switch 136 is closed and the control relay #2CR is deenergized, via the set of N.C. contacts #2-2 associated with control relay #2CR (FIG. 8). A conduit 222 from the valve 216 has a conventional bleed valve 224 located therein, and the conduit 222 is connected to one end of the cylinder 100 to return the finger means 68 (shown only schematically in FIG. 9) to the home position shown in FIG. 1 when the reversing valve 216 is in the position shown in FIG. 9. A conduit 226, having a conventional flow control valve 228 therein, is connected to the opposite end of the cylinder 100, and the conduit 226 is connected to a "T" connector 230. One end of the connector 230 is connected to the reversing valve 216 via a conduit 232, and the other end is connected to the cylinder 60 via a conduit 234. The arm 64 of the cylinder 60 is returned to the position shown in FIGS. 9 and 1 by a compression type spring 236, in which position, the clamping means 18 is disengaged from length 24 of ribbon. An exhaust conduit 238 connects the reversing valve 216 to an exit or exhaust port 240 where the used air is exhausted to the atmosphere.

The automatic operation of the apparatus 10 is as follows. After a cassette 16 is positioned on the apparatus 10 with the finger means 68 being in the home position shown in FIG. 1, a length 24 of ribbon in the cassette 16 is automatically positioned to be engaged by the fingers 70, 72 of the finger means 68. The desired number of cycles of ribbon to be pulled out of the cassette 16 is then set on the counter 158 (FIG. 8), and the main switch 136 is closed to energize the control means 116. Because the finger means 68 is in the home position, the limit switch 112, the limit switch 108, and the photoswitch PS-1 will be in the positions shown in FIG. 8 to reset the counter 158 via the N.C. contacts #1-3 of control relay #1CR, which at this time, is not energized. When the cycle start switch 140 is closed, the control relay #1CR is energized, and it energizes control relay #2CR via limit switch 112, limit switch 108, photoswitch PS-1 and the N.O. contacts #1-2 of control relay #1CR which close upon the energization of control relay #1CR to also energize solenoid 184. When control relay #2CR is energized, its associated N.O. contacts #2-1 become closed to provide a holding circuit therefor. The solenoid 184, upon energization, then switches or pulls the reversing valve 216 to the opposite position from that shown in FIG. 9, causing the arm 64 of the cylinder 60 to move the clamping means 18 (FIG. 1) to clamp a portion 20 of the ribbon as previously explained, and also causes the energization of the cylinder 100, which moves the finger means 68 towards the limit switch 112, thereby pulling a length 24 of ribbon out of the cassette 16 as previously explained. As the finger means 68 moves away from the home or first position shown in FIG. 1, limit switch 108 is opened, and as the length 24 of ribbon blocks the path of light from light source 188, the photoswitch PS-1 is opened and simultaneously the photoswitch PS-2 is closed to partially set up an energizing circuit for the rewind motor 124; the now closed contacts #2-1 of control relay #2CR keep it and solenoid 184 energized. The length 24 of ribbon continues to be pulled out of the cassette 16 untl the finger means 68 engages the limit switch 112 causing it to switch to terminal 192, thereby completing the energizing circuit to motor control relay MCR via now closed photoswitch PS-2, and also completing the energizing circuit to rewind motor 124 via conductor 198. As soon as limit switch 112 is switched to contact 192, control relay #2CR is deenergized to deenergize solenoid 184, and the N.C. contacts #2-2 close to energize solenoid 185 to switch the reversing valve 216 to position shown in FIG. 9, thereby disabling the clamping means 18, and permitting the operating arm 104 of cylinder 100 to be returned to the home position shown in FIG. 9. As the finger means 68 moves away from limit switch 112, it switches to engage terminal 166 (FIG. 8) to partially set up an energizing circuit for control relay #2CR. The return stroke of arm 104 is controlled by the bleed valve 224 (FIG. 9), and the return stroke of arm 64 of cylinder 60 is quickly made via the spring 236 to release the ribbon 24. When motor control relay MCR is energized, its associated N.O. contacts M-1 provide a holding circuit therefor, and the associated N.O. contacts M-2 close to register a count of one on the counter 158. Because rewind motor 124 is also energized, it will return the length 24 of ribbon back into the cassette 16 as previously explained. The bleed valve 224 is designed to enable the operating arm 104 to return to the home position shown in FIG. 1 at a rate which is slightly faster than the rate at which rewind motor 124 returns the length 24 of ribbon back to the cassette 16 to minimize the tension on the ribbon as it is being returned or pushed into the cassette 16.

As the finger means 68 approaches the home position shown in FIG. 1 due to the "rewinding" operation in progress, the length 24 of ribbon will pass the photoswitch 172 causing it to be actuated by having light from light source 188 reach the photodetector 190 (FIG. 4); this results in photoswitch PS-1 (FIG. 8) being closed and photoswitch PS-2 being simultaneously opened after a slight delay of a few milliseconds to enable the rewind motor 124 to pull the operating arm 104 of cylinder 100 to the home position where the finger means 68 engages the limit switch 108 causing it to close. At this time, the motor control relay MCR and rewind motor 124 are deenergized when the photoswitches PS-1, PS-2 (after the time delay) are switched to the positions shown in FIG. 9.

Because the control relay #1CR is still energized via its holding circuit (including its associated contacts #1-1), the cycle just described will be repeated through control relay #2CR being energized through the limit switch 112, limit switch 108, and photoswitch PS-1 as previously described, and another count will be registered on the counter 158. When the count which has been set upon the counter 158 is reached (after about five cycles, for example), the normally closed contacts 156 (FIG. 8) associated with a full count on the counter 158 will be opened to break the holding circuit to control relay #1CR, thereby completing the predetermined number of cycles for equalizing the tension on the ribbon in cassette 16. The cassette 16 can then be removed from the apparatus 10 and a new cassette 16 positioned on the apparatus 10 to repeat the process just described.

The number of cycles required to equalize the tension of the ribbon in the cassette 16 naturally depends upon the particular type of cassette 16, ribbon etc. used; however, the principles employed herein can be utilized for different cassettes. In one embodiment of this invention, the flow control valve 228 (FIG. 9) was selected to pull the ribbon out of the cassette 16 by having the cylinder 100 advance the finger means 68 towards the second position at a rate of approximately four inches per second, and the rewind motor 124 was selected to have the length 24 of ribbon returned to the cassette at a speed of about 375 inches per minute which speed approximates the speed at which the ribbon is driven when the cassette 16 is in normal operation on a utilization device like an accounting machine, for example. The pressures used in the pneumatic system are conventionally selected so that if the length of ribbon binds within the cartridge as it is being pulled out, the actuating arm 104 of the cylinder will stall, permitting the operator of the apparatus 10 to check the ribbon in the cassette 10 for possible binding; this avoids having the ribbon torn while it is on the apparatus 10. A sensing means like a pressure relief valve 229 (FIG. 9) associated with the flow control valve 228 can be set to a predetermined pressure to enable the actuating arm 104 of the cylinder 100 to stall out to prevent the ribbon from being torn.

What is claimed is:

1. An apparatus for equalizing the tension of a ribbon in a cassette of the stuffed ribbon variety having an exit area and an entrance area between which a first portion of said ribbon is exposed, comprising:

a frame for detachably mounting said cassette thereon;

means for clamping said first portion to prevent said ribbon from being pulled out of said entrance area;

means for pulling a length of said ribbon out of said cassette by pulling said first portion between said clamping means and said exit area; and means for driving said length of ribbon back into said cassette through said entrance area upon the release of said clamping means;

said pulling means comprising finger means to slidably engage said first portion of said ribbon; said finger means being movable between first and second positions on said frame; and actuating means for moving said finger means from said first position to said second position to thereby pull out said length of ribbon from said cassette;

said finger means including first and second spaced fingers and said pulling means also including a post which is fixed to said frame; said post being positioned between said first and second spaced fingers when said finger means is located at said first position to enable said length of ribbon to be pulled out of said cassette in multiple sub-lengths so as to maximize said length of ribbon pulled out of said cassette as said fingers are moved from said first position to said second position.

2. The apparatus as claimed in claim 1 in which said multiple sub-lengths are formed by said length of ribbon being routed from said exit area to around said first finger, from said first finger to around said post, from said post to around said second finger, and from said second finger to said clamping means.

3. The apparatus as claimed in claim 1 in whch said pulling means further comprises a carrier means with said first and second fingers being mounted on said carrier means; and said pulling means further comprises a track means for slidably mounting said carrier means thereon for reciprocal movement between said first and second positions by said actuating means.

4. The apparatus as claimed in claim 3 in which said actuating means has fluid sensing means to sense the amount of tension on said length of ribbon being pulled out of said cassette so as to deactivate said actuating means when said tension exceeds a predetermined value; and said actuating means comprises a fluid operated actuator which operates at a speed in returning from said second position to said first position so as to minimize the tension on said length of ribbon as it is driven back into said cassette by said driving means.

5. An apparatus for automatically equalizing the tension of a ribbon in a cassette of the stuffed ribbon variety having an exit area and an entrance area between which a first portion of said ribbon is exposed, comprising:

a frame means with means for mounting said cassette thereon;

means for clamping said first portion to prevent said ribbon from being pulled out of said entrance area;

means for pulling a length of said ribbon out of said cassette by pulling first said portion between said clamping means and said exit area; and means for driving said length of ribbon back into said cassette through said entrance area upon the release of said clamping means;

a pulling of a length of ribbon out of said cassette and driving said length back into said cassette comprising one cycle; and control means including a settable counter for controlling said clamping means, pulling means, and driving means to enable said cycle to be repeated a predetermined number of times set upon said counter;

said pulling means comprising finger means to slidably engage said first portion of said ribbon; said finger means being movable between first and second positions on said frame means; and actuating means for moving said finger means from said first position to said second position to thereby pull out said length of ribbon from said cassette;

said finger means including first and second spaced fingers and said pulling means also including a post which is fixed to said frame means; said post being positioned between said first and second spaced fingers when said finger means is located at said first position to enable said length of ribbon to be pulled out of said cassette in multiple sub-lengths as said first and second spaced fingers are moved from said first position to said second position.

6. The apparatus as claimed in claim 5 in which said multiple sub-lengths are formed by said length of ribbon being routed from said exit area to around said first finger, from said first finger to around said post, from said post to around said second finger, and from said second finger to said clamping means.

7. The apparatus as claimed in claim 5 in which said pulling means further comprises a carrier means with said first and second spaced fingers being mounted on said carrier means; and said pulling means further comprises a track means for slidably mounting said carrier means thereon for reciprocal movement between said first and second positions by said actuating means.

* * * * *

UNITED STATES PATENT OFFICE

CERTIFICATE OF CORRECTION

Patent No. 4,082,210 Dated April 4, 1978

Inventor(s) James A. Gottschlich

It is certified that error appears in the above-identified patent and that said Letters Patent are hereby corrected as shown below:

Column 10, line 8, delete "first said" and substitute --said first--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*